United States Patent [19]

Moe et al.

[11] 4,227,693

[45] Oct. 14, 1980

[54] TOY RACING TRACK

[75] Inventors: Walter Moe, Los Angeles, Calif.; Charles M. Diker, New York, N.Y.

[73] Assignee: Diker Moe Associates, West Los Angeles, Calif.

[21] Appl. No.: 966,875

[22] Filed: Dec. 6, 1978

[51] Int. Cl.[3] ..... A63F 9/14

[52] U.S. Cl. ..... 273/86 C; 46/202

[58] Field of Search ..... 273/86 C, 110; 46/202, 46/206; 104/58, 79

[56] References Cited

FOREIGN PATENT DOCUMENTS

| | | | |
|---|---|---|---|
| 888069 | 8/1953 | Fed. Rep. of Germany | 46/202 |
| 1908183 | 9/1970 | Fed. Rep. of Germany | 273/86 C |
| 426776 | 4/1935 | United Kingdom | 273/86 C |
| 688811 | 3/1953 | United Kingdom | 46/202 |

*Primary Examiner*—Anton O. Oechsle

[57] ABSTRACT

A toy racing track having a base and at least one essentially oval track for gravity-impelled toy cars. The oval track being segmented with two end sections at opposite sides of the base. In a preferred embodiment, the end sections are hinged to the base and linkage is provided which may be controlled to cause one section to incline upwardly from the base while the other is caused to incline downwardly.

2 Claims, 4 Drawing Figures

TOY RACING TRACK

BACKGROUND OF THE INVENTION

The background of the invention will be discussed in two parts:

1. Field of the Invention

This invention relates to toys and more particularly to a toy racing track which may be used wih gravity-impelled toy cars.

2. Description of the Prior Art

Many toy racing tracks have been devised. For example, there are sophisticated toy racing tracks which carry electrically-driven model cars in high speed races against one another; there are also less sophisticated racing tracks which allow battery-powered, motor-driven, and wind-up racing cars to race. In addition, there are simple inclined tracks which carry cars without motors or engines in races against one another.

However, most of the power driven cars, even the wind-up type, are too complicated for many pre-school children. Moreover, gravity-impelled cars racing down fixed inclined tracks do not provide the excitement of racing tracks in which some control may be exerted by an operator over the operation of the car as in the more sophisticated designs. Furthermore, the construction of many racing sets is sufficiently complicated that they are quite expensive. Consequently, most racing sets known in the prior art are not suitable for preschool children.

It is an object of the present invention to provide a new and improved toy racing track.

It is another object of the present invention to provide a new and improved toy racing track which may be used with gravity-impelled or powered toy cars.

It is still another object of the present invention to provide a new and improved toy racing track which provides for operator control of gravity-impelled cars racing against one another.

SUMMARY OF THE INVENTION

The foregoing and other objects of the invention are accomplished by a toy racing track having a central base portion at least a part of which includes a relatively flat upper surface across which toy cars may be driven. An essentially oval track for gravity-impelled cars is segmented into at least two sections and these sections are, in a preferred embodiment, hinged to opposite sides of the central base portion. Control means such as a steering wheel which may be supported by the central base portion operate linkage connected to the two segmented sections. By turning the steering wheel in a first direction, one of the segmented track sections is inclined downwardly from the central base portion while the other is inclined upwardly therefrom. A gravity-impelled car placed on the track sections may be caused to race about the track by manipulating the steering wheel to alternately raise and lower the opposing track sections.

In a preferred embodiment, two oval tracks are each segmented and connected to the central base portion. The two oval tracks are laid out so that they cross at the central base portion. Steering wheels are provided at opposite ends of the central base portion, each steering wheel being linked to the two segments of one of the oval tracks. A gravity-impelled car placed on one of the oval tracks may thus be controlled to be raced against a gravity-impelled car placed on the other oval track.

The toy racing track so provided is easy to operate, inexpensive to construct, and provides exciting enjoyment for young children.

Other objects, features, and advantages of the invention will become apparent from a reading of the specification when taken in conjunction with the drawing in which like reference numerals refer to like elements of several views.

DESCRIPTION OF THE PREFERRED EMBODIMENT

Figure 1:
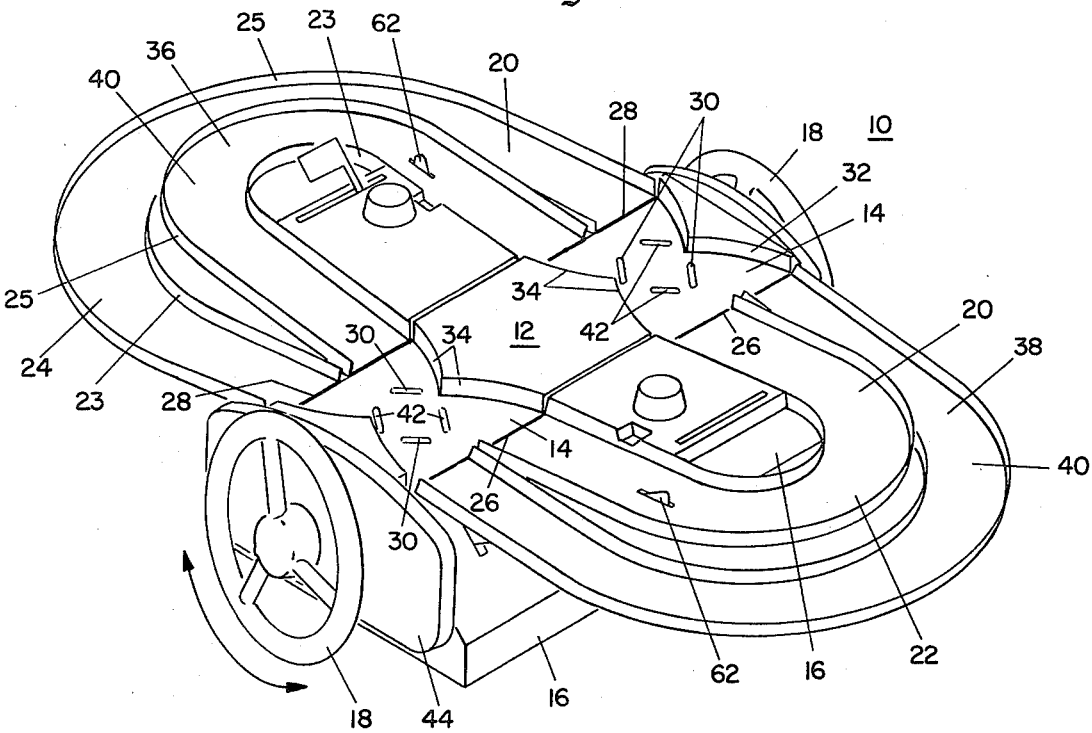
FIG. 1 is a perspective view of a toy racing track constructed in accordance with the invention.

Referring now to the drawings and, more particularly, to FIG. 1, there is shown a perspective view of a toy racing track generally designated 10 constructed in accordance with the invention. The toy racing track 10 has a central base portion 12. The central portion 12 may be constructed in a well-known manner of various materials, invluding molded plastic material, to provide a sturdy base for the toy. The central base porion 12 has a pair of generally horizontal track sections 14 which in the particular embodiment shown provide cross-over paths for toy racing cars. Central base porion 12 also includes a base 16 in which controls 18 may be supported. The controls 18 shown in the preferred embodiment comprise a toy steering wheel positioned in and supported by each end of the base 16.

Connected to the central base portion 12 are two essentially oval tracks which are segmented and hinged to the central portion 12. The first segmented track 20 includes a smaller inner section 22 shown to the right in FIG. 1 and a larger outer section 24 shown to the left in FIG. 1. Each of the track sections has inner and outer walls 23 and 25 adapted to contain racing cars inside the oval track. The section 22 is hinged to the central portion 12 along a line 26 while the section 24 is hinged to the opposite side of the central portion 12 along the line 28. The track sections 14 of the central portion 12 may include upwardly extending projections 30 which assist in guiding a toy car between the inner and outer sections 22 and 24 of the oval track 20. Also assisting in guiding a toy car through the sections 14 are the walls 32 and 34 which define the extremities of the track sections 14.

Also hinged to the central base portion 12 are a pair of segmented track sections 36 and 38 of a second essentially oval track 40. Each section 14 is also provided with a second set of upwardly extending projections 42 which assist in guiding a toy car through the cross-overs which form a part of the oval track 40.

Figure 2:
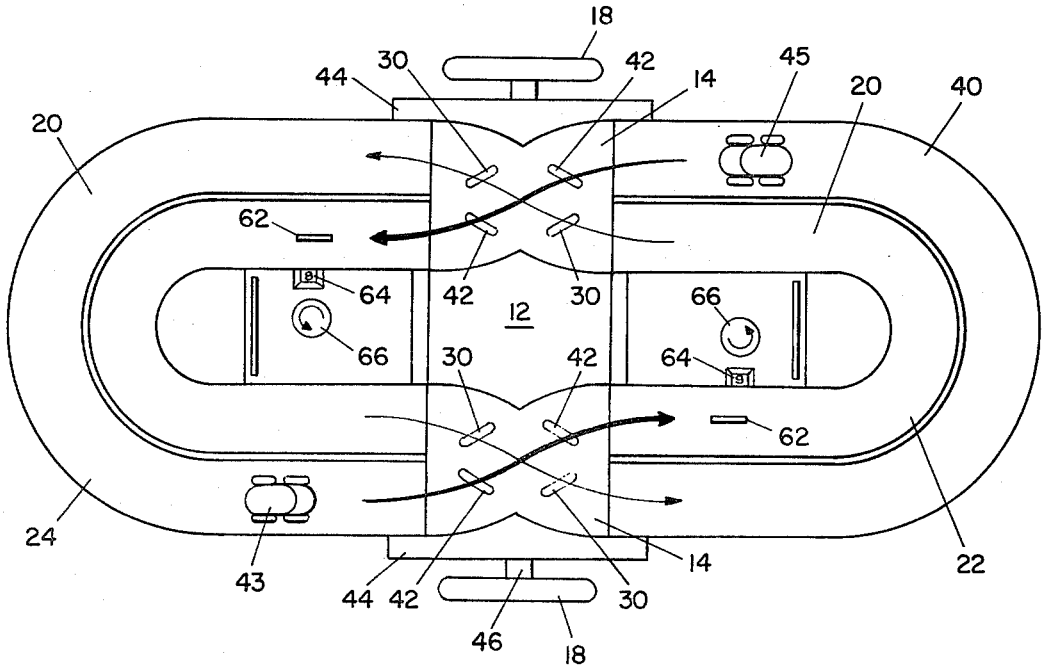
FIG. 2 is a top view of the toy racing track shown in FIG. 1.

The tracks 20 and 40 may be better visualized by viewing FIG. 2 which shows a pair of toy cars 43 and 45 positioned thereon and has arrows superimposed to demonstrate the movement of the cars through the cross-over track sections 14. FIG. 2 also shows more clearly how the projections 30 and 42 provide paths which assist in guiding the toy cars through the sections 14. The projections 30 and 42 are of a height selected to allow the passage of the central portion of a toy car on the other track while containing the wheels of a car on the track on which the car is traveling.

FIG. 2 also shows toy steering wheel controls 18 positioned at opposite ends of the central base portion 12. The steering wheels 18 are supported by the end walls 44 and the central base portion 12 and project therethrough. The steering wheels 18 rotate to the right and to the left over a distance controlled by linkage connected thereto for moving the segmented track sections 22, 24, 36 and 38.

Figure 3:
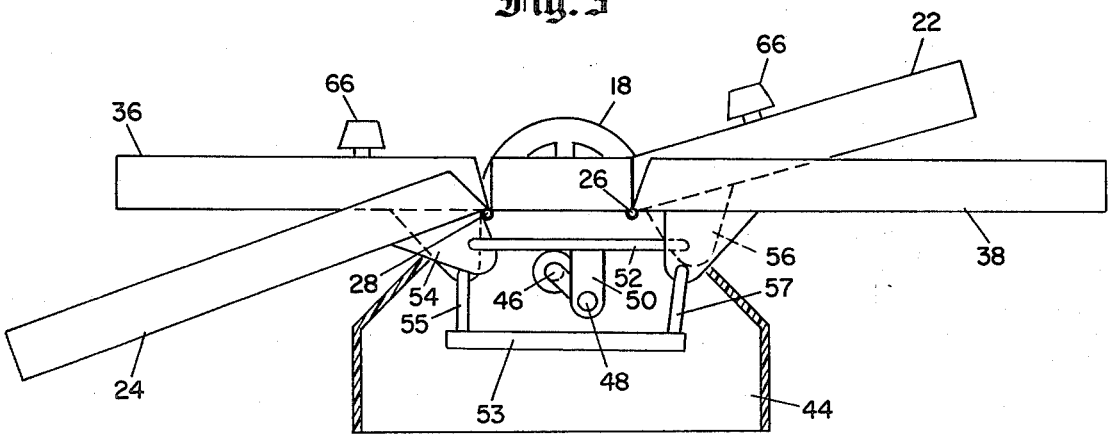
FIG. 3 is a front, partially cross-sectional, elevation view of the toy racing track shown in FIG. 1.

FIG. 3 is a front elevation view showing the toy racing track 10 of FIG. 1 with one of the end walls 44 cut away so that the interior linkage may be better understood. The steering wheel 18 is connected to a shaft 46 which projects through the end wall 44, is supported thereby, and rotates therein. The shaft 46, which may be constructed of steel, is bent at an essentially right angle to itself as it projects into the interior of the central base portion 12 and at a second right angle thereafter so that it ends in a shaft 48 coaxial with the steering wheel 18. The shaft 48 is rotatably connected to a fixture 50 which may be made of metal or plastic and depends from and is fixed to a bar 52. The bar 52 is rotatably mounted at each of its ends to flat projections 54 and 56 which depend from the track sections 24 and 22, respectively, the projections 54 and 56 fit through slots of the walls of the central base portion 12. A linking bar 53 rotatably connects through arms 55 and 57 to projections depending from sections 36 and 38. The control assemblage connecting the wheel 18 to the sections 22 and 24 is matched by a second assemblage (not shown) connected to the other steering wheel 18 and the track sections 36 and 38.

Operations of the steering wheel 18 in a first direction will cause the fixture 50 to move to the right as shown in FIG. 3 moving the bar 52 thereby rotating the track section 22 about the hinges 26 and causing the section 22 to move upwardly. At the same time, the bar 52 will cause the section 24 to rotate about the hinges 28 and move downwardly. Movement of the steering wheel 18 (shown in FIG. 3) in the opposite direction will cause the depending member 50 and the bar 52 to move to the left as shown in FIG. 3 thereby moving section 24 upwardly and section 22 downwardly.

As may be seen in FIGS. 1 and 2, if a toy car 43 is placed upon the oval track 20, it may be cause to move about the track simply by turning the steering wheel 18 reapeatedly, frist to the left and then to the right. For example, the toy car 43 positioned as shown in FIG. 2 will, if the section 24 is raised move to the right and across the section 14 of central base portion 12 and down the incline formed by the section 22. As the vehicle 43 approaches the right hand end of the section 22, the steering wheel 18 may be turned to raise the section 22; and the inertia of the car 43 will carry it around the turn shown at the right of the oval track 20. At this point, the car 43 will be going downhill toward base portion 12 as the section 22 will have been raised. Vehicle 43 will continue through the upper section 14 and downhill through the downhill incline of the section 24. As the car 43 approaches the left hand end of the section 24, the steering wheel 18 may be turned in the opposite direction raising the section 24. The inertia of the car 43 will, if the steering wheel 18 is turned at the proper rate and time, cause the car 43 to negotiate the turn and continue downhill along the now downwardly-inclined section 24.

As may be seen from FIGS. 1 and 2, cars placed on the opposite racing ovals 20 and 40 may be caused to race against one another by operating the upper and lower steering wheels 18.

The particular racing track shown in FIGS. 1, 2, and 3 may have included a pair of mechanical counters which are constructed in a well-known manner and comprise upwardly-projecting knob 62 which may be depressed by a car as it passes. The knob 62 will be depressed to cause a counter 64 to indicate one number higher. The counter may be reset by knob 66 to zero. By utilizing the counters at each end of the central track sections 22 and 36, the laps in a particular race may be counted. A counter such as that used in the particular racing set is well-known in the art. Also shown are a pair of flags 68 which rise to signal the completion of a particular number of laps.

In a particular racing set constructed in accordance with the invention all of the parts are constructed of a molded rigid plastic material other than those parts which comprise the linkage members and the shafts 46. Consequently, the device constructed in accordance with this invention may be constructed quite inexpensively. Furthermore, the invention requires gravity-impelled cars. Consequently, a great deal of expense required by cars using motors and the like is eliminated. The operation of the race track 10 constructed in accordance with this invention being controlled by the operator's manipulating the steering wheels 18 lends a substantial amount of excitement to the action of the vehicles moving about the track. The fact that only a simple toy steering wheel is used to control the car makes the toy racing track of this invention useful for very young children who are able to derive a great deal of pleasure therefrom.

Figure 4:
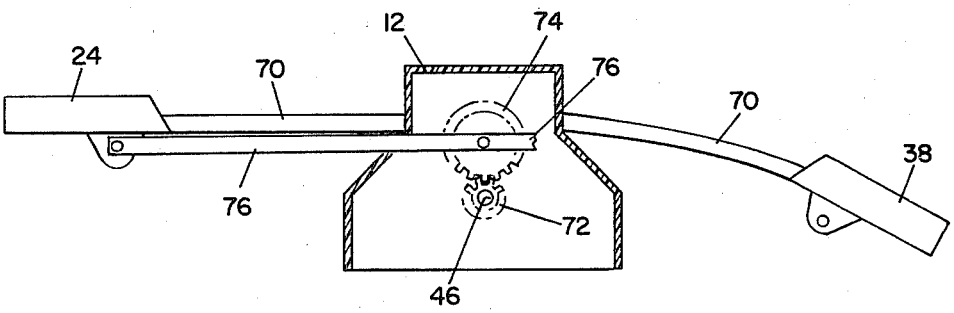
FIG. 4 is a front, partially cross-sectional, elevation view of another embodiment of a toy racing track constructed in accordance with the invention.

FIG. 4 illustrates a second embodiment of the invention. FIG. 4 is a front elevation view of a racing track shown in partial cutaway to illustrate the internal linkage. The racing track includes a central base portion 12 constructed as shown in FIGS. 1, 2, and 3 to which may be connected one or more oval racing tracks with segmented portions 24 and 38 also constructed as illustrated in FIGS. 1, 2, and 3. The segmented portions 24 and 38, and portions 22, and 36 (not shown) are, however, connected to the central portion 12 by means of a flexible track 70. The flexible track is fixed to the central track portions 14 to the right and left sides of central portion 12 and to the sections 22, 24, 36, and 38. In the particular embodiment shown in FIG. 4, a steering wheel (not shown) is connected to the shaft 46 which connects to a gear 72. The small gear 72 drives a larger gear 74 which has a bar 76 affixed to its axis. The bar 76 is rotatably connected at its opposite ends to one of the end sections (such as end section 24 shown in FIG. 4). Rotating the steering wheel 18 will cause the shaft 46 to rotate thereby driving the gear 72 against the gear 74 causing the bar 76 to move the end sections upwardly and downwardly. Restraining means (not shown) may be utilized to limit the movement of the end sections. In FIG. 4, the end section 38 is shown in a downwardly-inclined position. The linkage of the end section 38 to a steering wheel is not shown but it would be essentially identical to that which is illustrated connected to the end section 24. Furthermore, the end section 36 (not shown) would be elevated by similar linkage in the particular embodiment shown in FIG. 4 in order that a car might be moved about the oval track 40 to which the end section 38 belongs.

Other embodiments might also be constructed which would also cause the tracks sections to be alternately raised and lowered thereby moving a toy car about an oval track section. It is also obvious that wind-up and powered cars could be used on the track of this invention to lend additional excitement. While there has been shown and described various embodiments, it is to be understood that various other adaptations and modifications may be made within the spirit and scope of the invention.

What is claimed is:

1. A toy racing track comprising a generally oval track divided into at least two sections; means for suspending said sections adjacent one another to provide a complete track, said means including a central base portion and flexible track connecting each of said sections to the central base portion; and means for controlling at least one of said suspended sections to incline upwardly and downwardly from the other of said sections.

2. A toy racing track comprising a pair of generally oval tracks each divided into at least two sections, means for suspending said sections of each of the oval tracks adjacent the other to provide a complete track, said means for suspending including a central base portion hinged to each of said track sections such that one track section of a first oval track lies inside one track section of the other oval track while a second track section of the first oval track lies outside a second track section of the second oval track, and means for controlling at least one of said suspended sections of each of said tracks to incline upwardly and downwardly from the other of said sections, said central base portion including means for directing toy vehicles racing on said oval tracks to cross over at said central base portion.

* * * * *